US005375643A

United States Patent [19]

Rude

[11] Patent Number: 5,375,643

[45] Date of Patent: Dec. 27, 1994

[54] SPRING CLUTCH ASSEMBLY WITH REDUCED RADIAL BEARING FORCES

[75] Inventor: Edward T. Rude, Columbia, Md.

[73] Assignee: General Clutch Corporation, Stamford, Conn.

[21] Appl. No.: 995,422

[22] Filed: Dec. 22, 1992

[51] Int. Cl.[5] ..... E06B 9/56

[52] U.S. Cl. ..... 160/321; 160/292; 160/298; 192/415; 192/81 C; 192/48.92

[58] Field of Search ..... 160/321, 291, 292, 298, 160/307; 192/41 S, 81 C, 48.92

[56] References Cited

U.S. PATENT DOCUMENTS

| | | | |
|---|---|---|---|
| 2,242,379 | 5/1941 | Wahl | 192/81 C |
| 2,577,181 | 12/1951 | Christensen | 192/41 S |
| 2,643,750 | 6/1953 | Moulton | 192/81 C X |
| 4,318,314 | 3/1982 | Furedi et al. | 192/41 S X |
| 4,341,292 | 7/1982 | Acevedo | 192/41 S X |
| 4,372,432 | 2/1983 | Waine et al. . | |
| 4,433,765 | 2/1984 | Rude et al. . | |
| 4,443,125 | 4/1984 | Hirano | 192/41 S X |
| 4,751,953 | 6/1988 | Appel et al. | 160/321 X |
| 4,779,662 | 10/1988 | Wilk | 160/321 |
| 4,905,803 | 3/1990 | Boyd | 192/41 S |
| 5,058,720 | 10/1991 | Rude et al. . | |
| 5,167,269 | 12/1992 | Abo | 160/321 X |

FOREIGN PATENT DOCUMENTS

| | | | |
|---|---|---|---|
| 431900 | 9/1967 | Switzerland | 160/321 |

*Primary Examiner*—Blair M. Johnson
*Attorney, Agent, or Firm*—Gottlieb, Rackman & Reisman

[57] ABSTRACT

A spring clutch assembly with reduced radial bearing forces is described. The clutch includes a shaft, at least first and second helically wound axially mounted springs for making frictional contact with the shaft, and engaging means corresponding to each of the first and second springs for selectively applying a tightening force to one end of each of the springs in order to prevent rotation with respect to the shaft. Each of the engaging means is radially and symmetrically disposed along the shaft for eliminating radial bearing force induced by the spring ends.

30 Claims, 8 Drawing Sheets

SPRING CLUTCH ASSEMBLY WITH REDUCED RADIAL BEARING FORCES

BACKGROUND

Our invention relates to spring clutches, and more particularly, to spring clutches in which the force controlling the output element results from contact with an end, or tang, of the clutch spring. As the output element of the clutch rotates, the direction of this force also rotates. In some applications of the clutch, the combination of this rotating force with other more constant forces produces an undesirable surging, or variation in the force required to operate the blind. Also, in order to balance the moment produced by this force, frictional forces are internally generated within the clutch which make its operation more difficult.

U.S. Pat. Nos. 4,372,432 and 4,433,765 both disclose spring clutches having the disadvantage described above. These clutches are intended principally for raising and lowering window shades, venetian blinds, pleated shades and other window treatments that move vertically. These devices are inexpensively built, manually operated devices, without ball or roller bearings of any sort, in which coaxial plastic parts support the weight and ride on one another. High operating force, frictional drag or variations in the force required to move the blind are perceived to be unpleasant, and give an impression of rough operation and poor quality. Nevertheless, because of the construction, frictional drag and uneven operating force are intrinsically present in these prior art devices. Our invention provides a means for minimizing the frictional drag and the variations in operating force.

SUMMARY OF THE INVENTION

Prior art clutches, whether they have a single spring or multiple springs, support the load with forces applied to a single feature of the output element of the clutch. The clutch disclosed in U.S. Pat. No. 4,433,765 employs more than one spring to support the hanging weight of the shade. Each of the springs therein has its loaded tang oriented substantially in the same direction about the axis of the device. The application of these supporting forces in an asymmetrical manner about the axis of the clutch produces reaction forces at the bearing surface within the clutch. It is the combination of the forces from the spring tangs and those from bearing reactions that, acting together, comprise the force couple, or torque, that supports the shade.

According to the principles of our invention, a clutch employing a multiplicity of springs can be configured to support the output load with very nearly a pure couple without producing reaction forces in the bearings as a direct result of the forces produced by the springs. This can be accomplished by redesigning the elements that interface with the spring tangs so as to provide interfacing surfaces symmetrically disposed about the axis of the device. For instance, when using two springs, the first spring tang can interact with surfaces on one side of the clutch, while the second spring can be installed so that its tang interacts with surfaces on the same diameter, but the opposite side, from those used by first spring. In this manner, pairs of springs can be caused to act together to form a force couple to control the movement of the clutch. It is important to configure the clutch so that the pairs of springs act in, or nearly in, a plane perpendicular to the axis of the clutch.

It should be noted that several other types of clutches, among them sprag, ratchet, or roller and polygon clutches, commonly have their restraining means, be they sprags, ratchet pawls, or rollers, symmetrically arranged about the central clutch element, thereby achieving the balance herein described. The reason that this balancing has not be implemented in spring clutches is that prior art spring clutches are most often designed with the spring bridging the gap between abutting cylindrical surfaces. Using this so called "split shaft" configuration, it is impractical to use more than one spring for supporting the load.

U.S. Pat. No. 4,253,553 taught the method for making a bi-directional spring clutch with a single spring contacting a single continuous surface, while making the torque connections to the two tangs of the spring. Prior to the inventive spring clutch described in U.S. Pat. No. 4,433,765, spring clutches did not have more than one spring, acting in parallel, for supporting the load. Our invention shows how, using the spring configuration taught in U.S. Pat. No. 4,433,765, to achieve the balanced operation commonly achieved in other, generally more expensive types of clutches.

Inexpensive spring clutches are frequently made of injection molded or diecast parts. Bi-directional clutches having multiple springs suffer from any unevenness in the surface with which the spring makes frictional contact. If the cylindrical surface about which the springs are disposed, or the cylindrical cavity within which the springs are contained is not uniform, then the tangs of identical springs will not be aligned. The use of interleaved pairs of springs minimizes the effects of any such unevenness in the spring carrying surface.

Accordingly, it is an object of our invention to provide an improved spring clutch assembly.

It is also an object of our invention to provide a clutch without bearing friction resulting from reaction to the output torque.

It is a further object of our invention to provide a spring clutch with reduced bearing loads.

Another object of our invention is to provide a cord or chain operated clutch without internal frictional forces that vary as the clutch rotates.

Yet another object of our invention is to provide a spring clutch in which total operating friction is reduced.

It is another object of our invention to provide a spring clutch in which the wear due to frictional forces is reduced.

It is a still further object of our invention to provide a spring clutch whose operation is smoother.

It is also an object of our invention to provide a spring clutch whose operation is less sensitive to unevenness of the spring bearing surface.

BRIEF DESCRIPTION OF THE DRAWINGS

Further object, features and advantages of our invention will become apparent upon consideration of the following detailed description in conjunction with the drawings, in which.

DETAILED DESCRIPTION OF THE DRAWINGS

Figure 1:
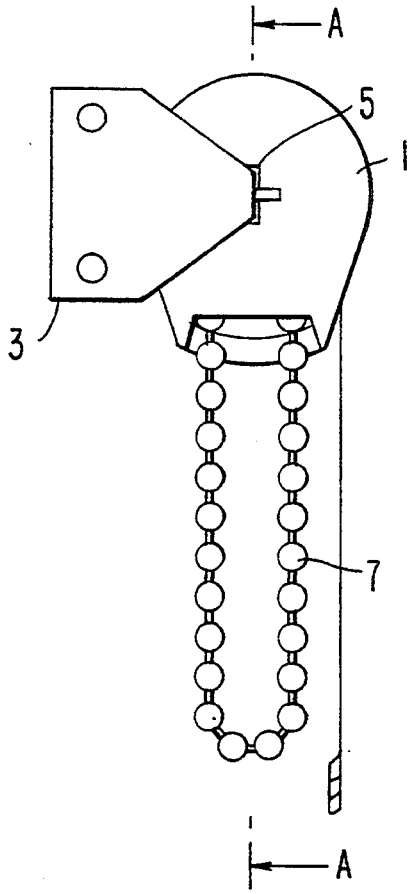
FIG. 1 PRIOR ART
FIG. 1 is an end view of a prior art spring clutch used to control a window shade.
Figure 2:
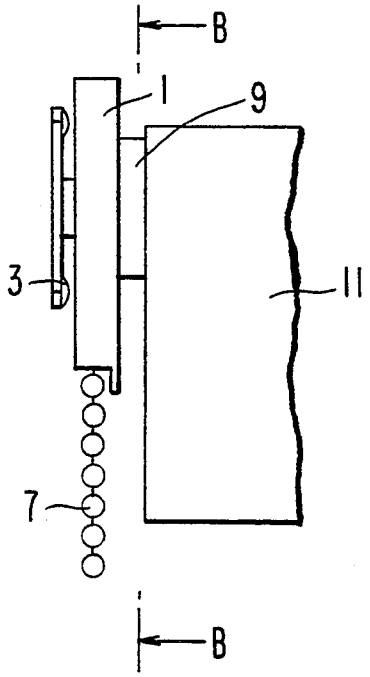
FIG. 2 PRIOR ART
FIG. 2 is a side elevation view of the clutch of FIG. 1.

FIG. 1 is an end view, showing a bracket and prior art spring clutch of a type often used to control window shades. Such clutches are typically operated by means of a control loop of cord or bead chain. Clutch 1 is shown in FIG. 1 mounted onto bracket 3 which mounts to a wall or the ceiling and fits into slot 5 in the end face of clutch 1. Control loop 7, used to raise and lower the shade, hangs below the clutch. FIG. 2 shows the same clutch, but from a different view in which shade roller tube 9 and shade fabric 11 are visible.

Figure 3:
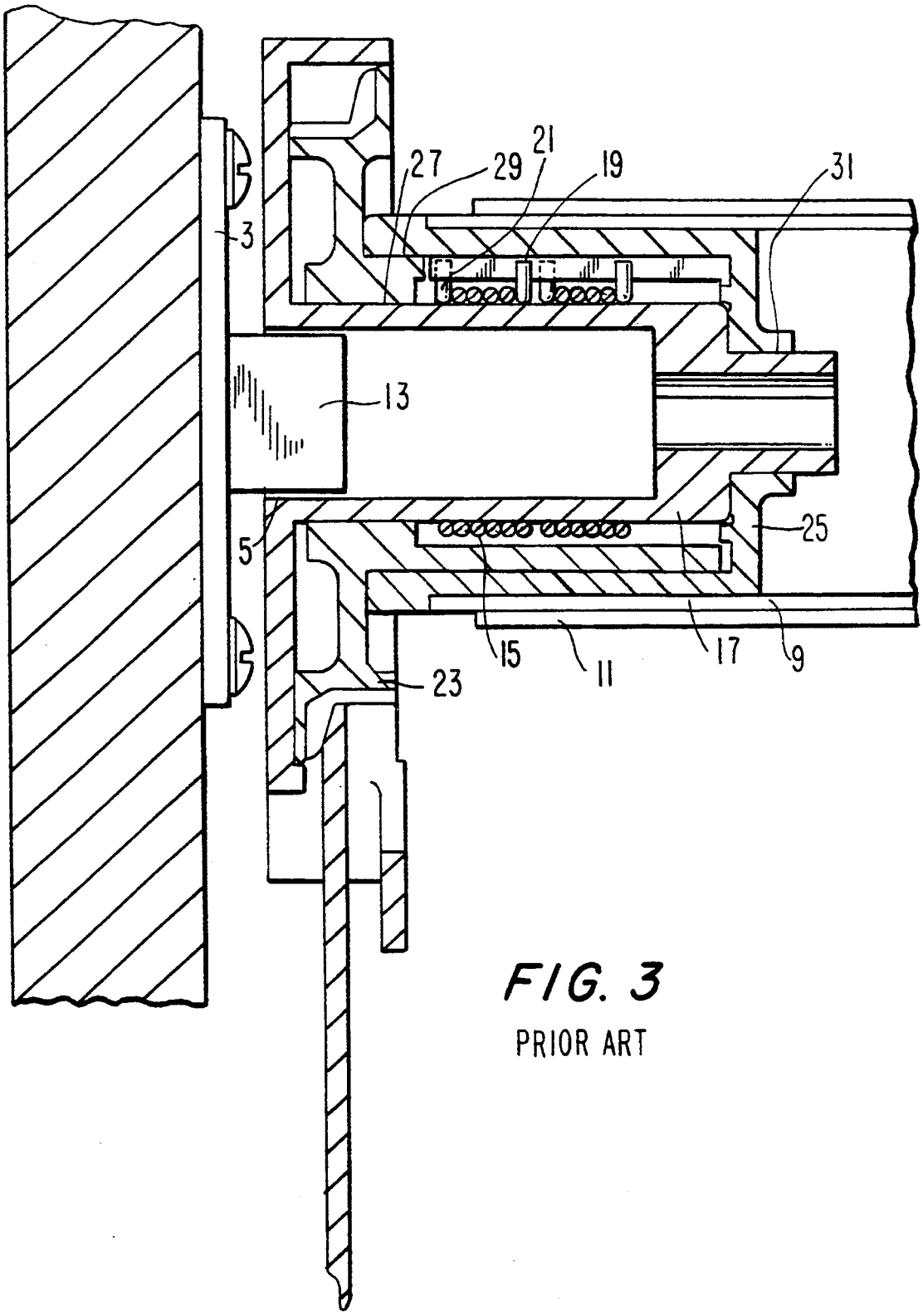
FIG. 3 PRIOR ART
FIG. 3 is a cross-sectional view of the clutch of FIG. 1 taken through the plane marked A—A in FIG. 1.

FIG. 3 is a cross-sectional view of the clutch of FIG. 1 taken through plane A—A as indicated in FIG. 1. The clutch end of the shade is supported by spear 13 of bracket 3 which fits into slot 5 of clutch 1, best seen in FIG. 1. The shape of spear 13 and slot 5 provide both rotational restraint and support for the weight of the shade. Spring 15 has a free diameter slightly smaller than the cylindrical outside diameter of shaft 17 about which it is wrapped. Spring 15 has outwardly bent tangs 19 and 21 for contacting surfaces on pulley 23 and housing 25.

Pulley 23 has smooth interior bearing surface 27 which fits over the outside diameter of shaft 17, permitting pulley 23 to rotate freely thereabout. Housing 25 fits over the smaller end of pulley 23 and has smooth, cylindrical, interior bearing surface 29 on which it mounts at one end, and similar but smaller surface 31 for its closed end mounting onto shaft 17. Shade 11 is wound about and attached to roller 9 which is press fit over the housing 25.

Figure 4:
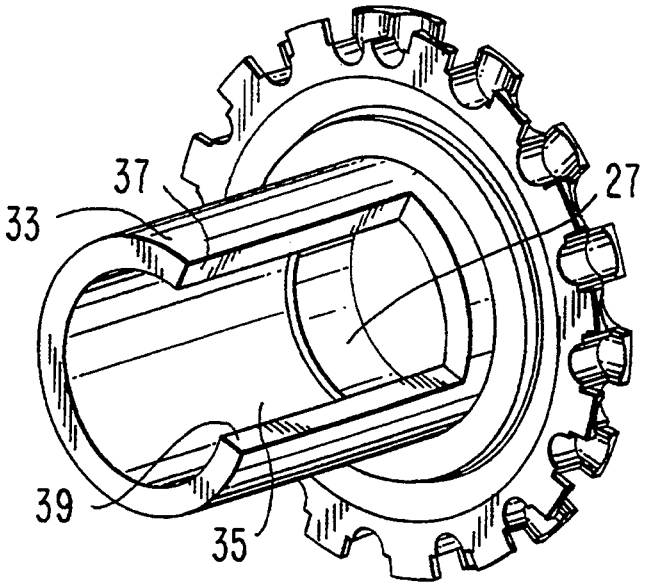
FIG. 4 PRIOR ART
FIG. 4 shows the pulley of the clutch of FIG. 1.
Figure 5:
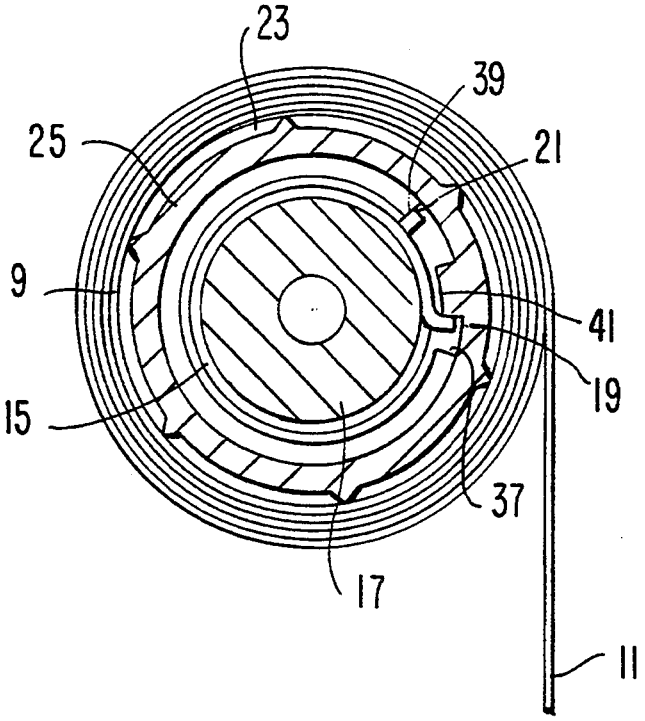
FIG. 5 PRIOR ART
FIG. 5 is a cross-sectional view of the same clutch taken through the plane B—B as marked in FIG. 2.

FIG. 4 shows pulley 23. Cylindrical extension 33 has opening 35 which is bordered on two sides by edges 37 and 39. FIG. 5 is a cross-sectional view of clutch 1 taken at the plane marked B—B in FIG. 2. Shade material 11 can be seen partially rolled onto shade roller tube 9 which is fitted over housing 25. Concentrically located within housing 25 is cylindrical extension 33 of pulley 23. Shaft 17 with spring 15 wrapped thereabout is coaxially positioned inside cylindrical pulley extension 33. Between edges 37 and 39 of opening 35, are tangs 19 and 21 of spring 15. Between tangs 19 and 21 of spring 15 is key 41 which extends in the axial direction along the inside surface of housing 25, protruding radially inwardly therefrom.

The operation of the clutch will be familiar to those skilled in the art, and can be understood as follows. Shaft 17, fixedly mounted onto bracket 3, remains stationary. The weight of shade fabric 11 produces a torque on shade roller 9 and housing 25 in the clockwise direction as seen in FIG. 5. As a result of this torque, housing 25 tends to rotate in the clockwise direction, bringing key 41 into contact with spring tang 19. The force of this contact tends to tighten spring 15 about shaft 17, increasing the frictional force between them, and preventing further motion. The position of the shade is changed by pulling on one or the other side of cord loop 7, which rotates pulley 23 in the corresponding direction. When pulley 23 rotates in the clockwise direction as seen in FIG. 5, edge 39 contacts tang 21 of spring 15. This tends to loosen the grip of spring 15 on shaft 11, allowing the spring, and with it, housing 25, to rotate, lowering the shade. For the opposite direction of rotation, edge 37 contacts tang 19, loosening the grip of spring 15 on shaft 17 permitting the spring to rotate about the shaft. Housing 25 is also caused to rotate by contact of tang 19 with key 41, thereby raising the shade.

Figure 6:
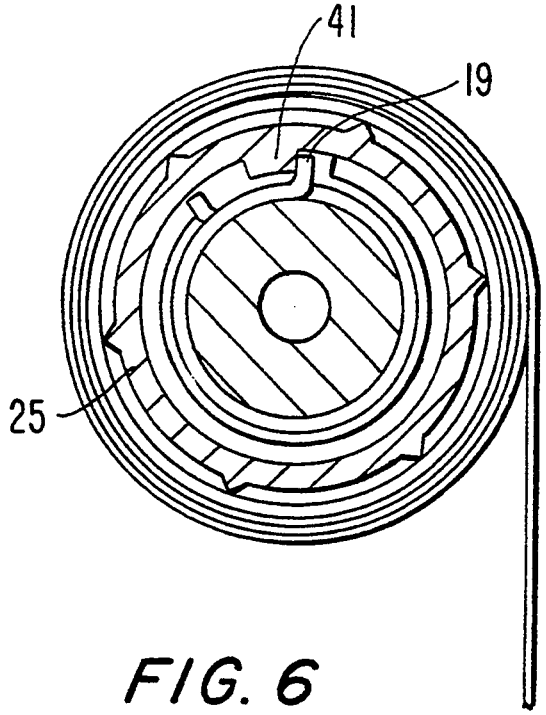
FIG. 6 PRIOR ART
FIG. 6 is view of the clutch housing of FIGS. 4 & 5, but with the shade rotated by 90 degrees in the counterclockwise direction as compared with the orientation shown in FIG. 5.

When the shade is rolled entirely onto roller 9, the weight of the shade, the roller, and the clutch mechanism act as if concentrated on the axis of the roller, the load being supported by spear 13 of bracket 3. As the shade is lowered, it hangs from one side of the roller, as shown in FIG. 5. The total supported weight is the same, but now a moment must be exerted on the clutch by the bracket to counteract the torque produced by the weight of hanging portion of the shade 11. A couple is formed by the weight of hanging portion of the shade 11 and an equal but opposite portion of the total support force exerted by spear 13. To counteract that couple and maintain equilibrium, another, opposing couple is formed by the force of spring tang 19 acting on housing key 41 and the bearing reaction to that force. The existence of the bearing force that arises in reaction to the force of tang 19 on key 41 can be most easily understood by consideration of FIG. 6 which shows housing 25 rotated so that the force applied by tang 19 to key 41 acts in a horizontal direction. With the shade stationary in this position, it is clear that the force of the spring tang on the key cannot be the only horizontal force acting on the housing. Horizontal equilibrium requires that there be an additional horizontal force. This additional force is the bearing reaction to the force applied by the spring tang, and is always equal to it in magnitude, and opposite in direction. These two forces, the force by spring tang 19 on key 41 and the resulting bearing reaction force, form a couple, C, that opposes the couple due to the weight of hanging portion of the shade 11.

The direction of these two forces rotates along with key 41 and housing 25 as the shade is rolled or unrolled, When the bearing reaction force is downwardly directed, it adds to the internal bearing load caused by the weight of the shade. When it is upwardly directed, it subtracts from those same internal bearing loads. As the shade moves, frictional forces at the interfaces between parts undergoing relative motion produce torques that must be overcome in order that the shade move. The frictional force at each bearing surface is proportional to the radial load between the parts. Since the radial load at bearing surface 31 and at bearing surface 27 fluctuate as two aforementioned forces rotate, the frictional drag produced at those bearing surfaces also varies. It is this variation that our invention seeks to minimize.

Since the effort required to,operate the shade increases as the bearing friction increases, our invention also provides a means for reducing the effort required to operate the shade.

In the following, detailed description of our invention, it will become clear how frictional drag is reduced and how surges in operating force are eliminated. In the illustrative example, application is made to the operation of a window shade. Other applications will be obvious to those skilled in the art.

Figure 7:
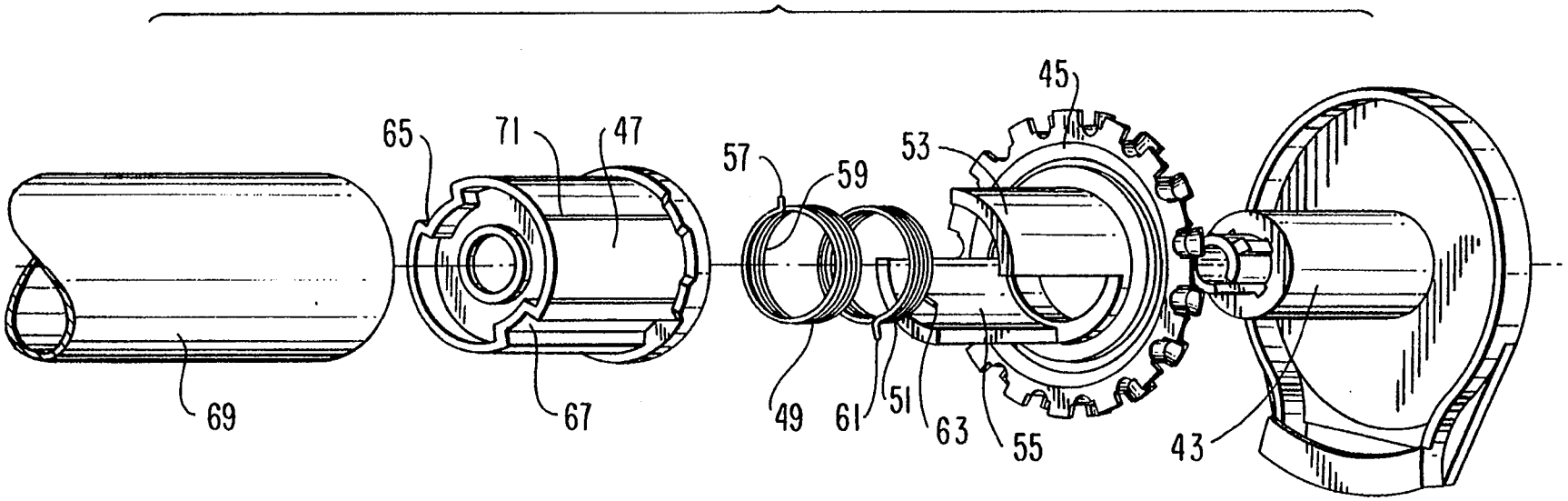
FIG. 7 is an exploded view of the clutch of our invention.

Our invention consists of a spring clutch employing a multiplicity of springs whose tangs are oriented at equal angular intervals within the clutch so that the net effect of the radial bearing loads induced by the spring tangs is zero. FIG. 7 is an exploded perspective view of a spring clutch incorporating the principles of our invention. Some of the parts of the clutch of FIG. 7 are identical to the corresponding parts of the clutch of FIGS. 1 through 6. The bracket system has been omitted from FIG. 7 for simplicity. The bracket system can be the same as the one shown in FIG. 1, although many other systems would work as well. The clutch shown in FIG. 7 has shaft 43 which can be the same as shaft 17 of FIG. 3. However, pulley 45, housing 47, and the arrangement of springs 49 and 51 are different from the example shown in FIGS. 1–6. Like the clutch of U.S. Pat. No. 4,433,765, the innovative clutch of FIG. 7 incorporates more than one spring. In the present example, two springs are used, although any number greater than one could be used, requiring only that sufficient axial length be provided.

Figure 8:
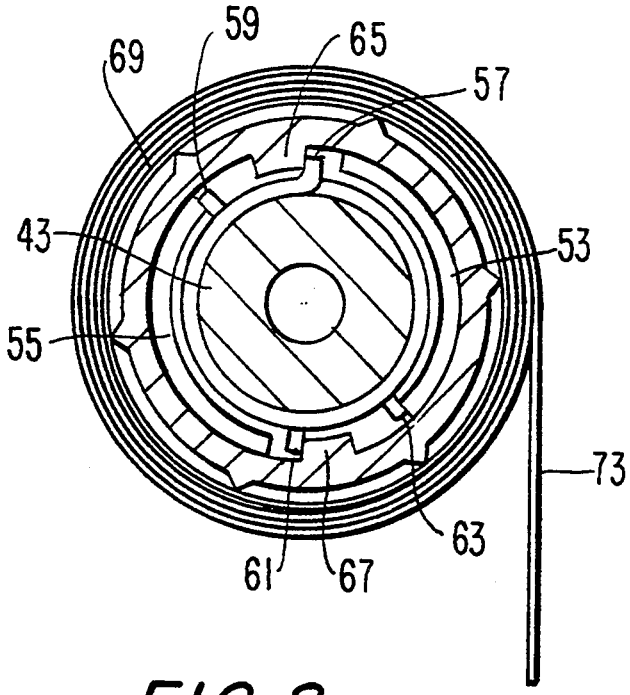
FIG. 8 is a cross-sectional view, similar to FIG. 3, but of the clutch of FIG. 7.

To continue comparing the clutch of FIGS. 1–6 and the clutch of FIGS. 7–8, whereas cylindrical extension 33 of pulley 23 of the clutch of FIGS. 1–6 has a single opening, 35, for receiving tangs 19 and 21 of spring 15, pulley 45 in FIGS. 7–8 has a cylindrical extension comprised of two drive sectors, 53 and 55. Tangs 57 and 59 of spring 49 lie within one of the two arcuate openings between drive sectors 53 and 55, while tangs 61 and 63 of spring 51 lie within the other opening. Also visible in both FIG. 7 and FIG. 8 are keys 65 and 67 of housing 47 for contacting the tangs of springs 49 and 51 respectively. As in the clutch of FIG. 1–6, roller 69 fits tightly over ribs 71 on the outside of housing 47.

Operation of the inventive clutch can best be understood by consideration of FIG. 8 which, most clearly, shows the relative positions of the controlling elements of the clutch. In FIG. 8, a portion 73 of the shade material is unrolled and hangs from roller 69. The weight of the portion 73 of the shade that hangs from the roller produces the torque that the clutch must support. The clutch supports this weight by preventing rotation of housing 47. The supporting forces are applied in two places. Key 65 contacts tang 57 of spring 49, tightening the spring about shaft 43 which is fixedly mounted to the shade bracket, and key 67 contacts tang 61 of spring 51, tightening it about shaft 43. In accordance with the principles of U.S. Pat. No. 4,433,765, each spring carries a part of the load. In FIG. 8, the line of contact between keys 65 and 67, and spring tangs 57 and 61 is vertical, and the forces between the keys and the spring tangs, therefore, are substantially horizontal. Since these forces are substantially equal in magnitude and opposite in direction, they produce little, if any, reaction in the bearings that support the housing, shade, and shade roller. The two forces form a couple whose torque opposes the torque due to the hanging weight of the shade. Drive sectors 53 and 55 of pulley 45 are in contact with spring tangs 59 and 63. Clockwise rotation of pulley 45 will tend to loosen both springs, permitting the shade to unroll. Counterclockwise rotation of pulley 45 would bring drive sectors 53 and 55 into contact with spring tangs 57 and 61, and continued counterclockwise movement would loosen both springs and rotate housing 47 so as to roll up the shade.

No matter whether the shade is being raised or lowered, the motion of housing 47 is controlled by the action of spring tangs 57 and 61 which form a force couple. As the shade rotates, this force couple rotates along with it, and the surging effect of the single spring is substantially eliminated.

U.S. Pat. No. 4,433,765 also uses more than one spring, but in that case, the tangs of each of the springs are oriented generally to one side of the clutch shaft, producing bearing loads which are substantially absent in the clutch of our invention.

As seen in FIG. 8, spring tangs 57 and 61 are symmetrically disposed about the axis of the clutch. In the preceding discussion, the two forces comprising the force couple have been treated as if they both lay in a single plane perpendicular to the axis of the clutch. However, as can been seen in FIG. 7, they lie in different planes along the axis. This separation of the planes in which the forces act means that the moment also has a component that is perpendicular to the axis of the clutch. This produces additional, undesirable bearing reaction forces. There are two general methods to reduce the component of the force moment perpendicular to the axis, either of which is capable of reducing it to the point of insignificance.

Figure 9:
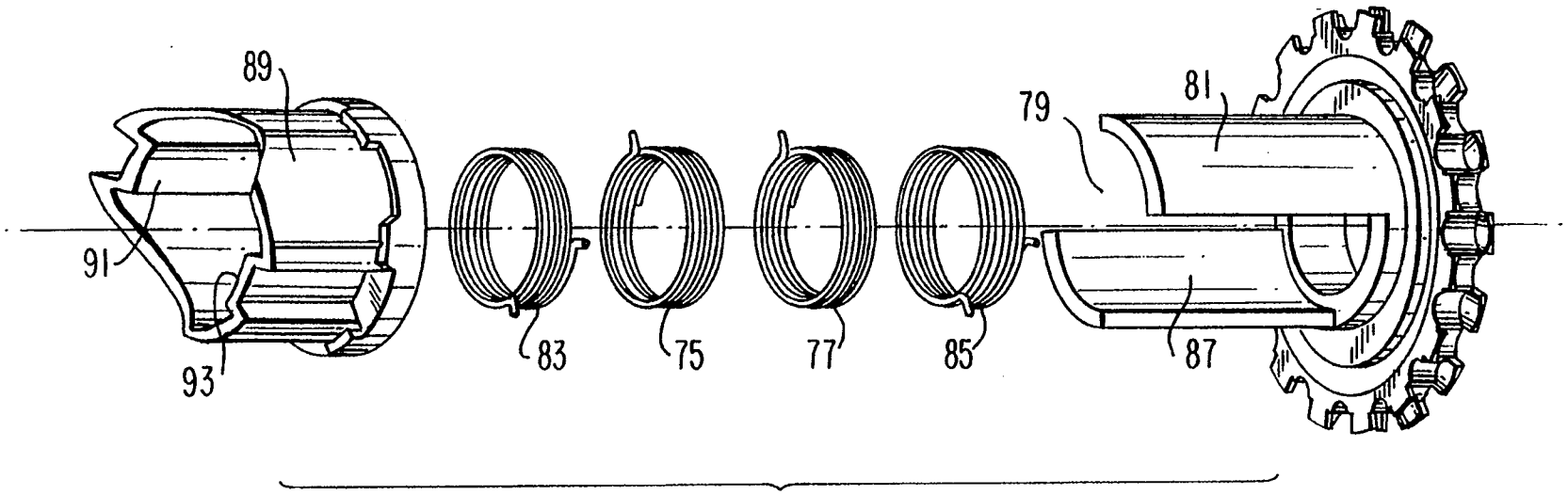
FIG. 9 is a partial, exploded view of a second embodiment of the clutch of our invention.

The first method consists of using a spring configuration that permits balancing the forces about a point on the axis of the clutch. FIG. 9 shows an exploded, view of a pulley, spring, and housing design using four springs. In this design inside springs 75 and 77 have tangs that occupy opening 79 in pulley extension 81, while outside springs 83 and 85 have tangs occupying opening 87 in pulley extension 81. Housing 89 has keys 91 and 93. Springs 75 and 77 act to support the load by contacting key 91 of housing 89, while outside springs 83 and 85 contact key 93. If the forces between each of the springs and the key which it contacts are equal, then there is a point on the axis about which the forces are symmetric, and no net moments perpendicular to the axis are produced. Therefore there are no bearing loads due to the axial separation of the spring tangs. Other spring arrangements, that will permit balancing of the spring forces about a point on the clutch axis, are easily imagined. An obvious one would use eight springs with tangs symmetrically disposed along the clutch axis. Another, less obvious, but possible arrangement would have 3 springs which share the load unequally. Two of the springs would support half the load and be on one side of the clutch, while the third spring would support the other half of the load on the side opposite the first mentioned two.

Figure 10:
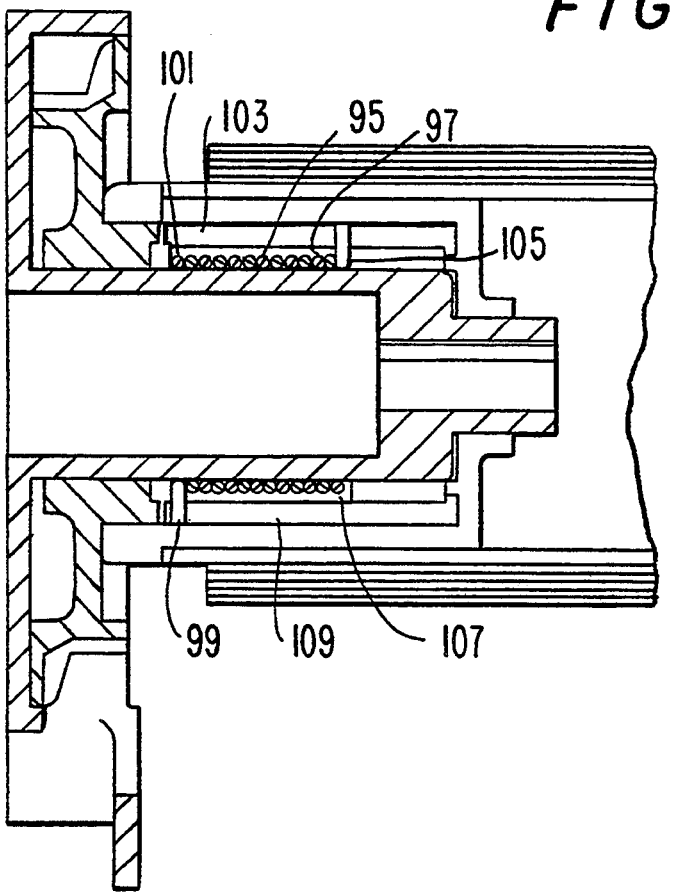
FIG. 10 is a cross-sectional view of another embodiment of our invention.

Another method, shown in FIG. 10, employs two identical springs, 95.and 97 that are interleaved so that the corresponding tangs of the springs are opposite one another and lie in planes perpendicular to the axis of the springs so that no moments are produced that are perpendicular to the axis of the clutch. For clarity, in FIG.

Figure 11:
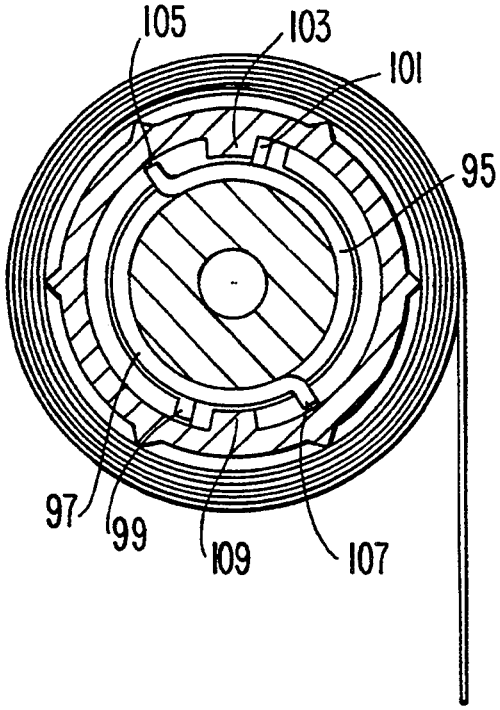
FIG. 11 is a cross-sectional view of the clutch of FIG. 10 showing the interrelationships of the spring tangs, the pulley drive sectors, and the housing keys.

10, the turns of spring 95 are shown in solid black. Because of the interleaving, tang 99 of spring 95 and tang 101 of spring 97 lie in a plane perpendicular to the axis of the clutch. In FIG. 10, tang 101 is partially hidden by key 103 of the housing, but tang 101 is clearly visible in FIG. 11. Similarly, tang 105 of spring 95 and tang 107 of spring 97 lie in the a plane perpendicular to the axis of the clutch. More complex arrangements of interleaved springs will also afford the advantages of the invention. For instance, three springs could be interleaved and used along with a housing that had three keys placed 120 degrees apart.

Figure 12:
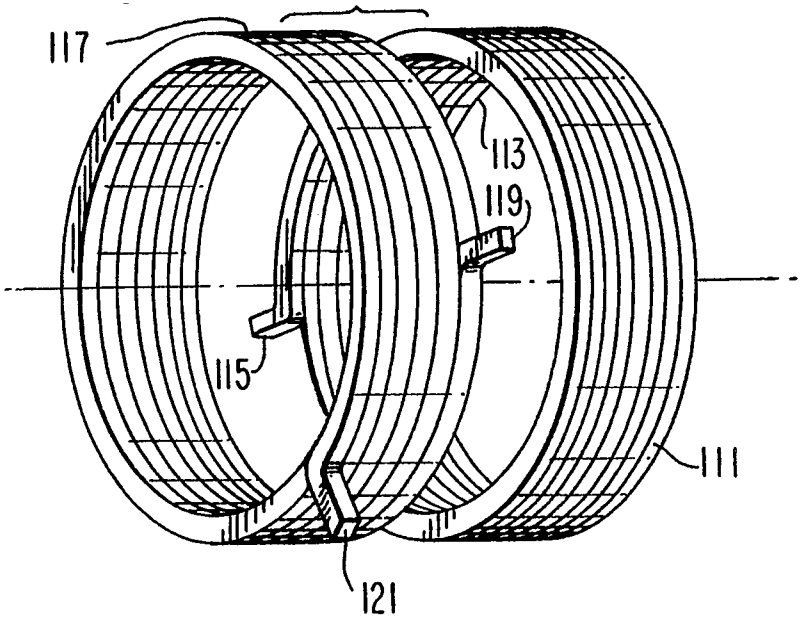
FIG. 12 is an isometric view of the springs of an additional embodiment of our invention; and, FIG. 13 is an exploded view of yet a further embodiment of our invention.

Yet another way to bring the spring tangs close together along the spring axis is to use two springs, one spring wound with a clockwise helix, and the other with a counterclockwise helix. FIG. 12 depicts a possible spring configuration for such a clutch. These springs could be used in place of springs 95 and 97 of the clutch of FIGS. 10 and 11 to provide the benefits of our invention for loading in one direction. In FIG. 12, spring 111 has tangs 113 and 115, and spring 117 has tangs 119 and 121. For use in the clutch of our invention, the two springs would be assembled over the shaft of the clutch and axially positioned so that tangs 115 and 119 were opposite one another and overlapped. For loads that tend to produce a counterclockwise rotation of the two springs, the housing keys would contact spring tangs 115 and 119 causing springs 117 and 111 to tighten and support the load. Since the two tangs lie in a plane perpendicular to the axis of the springs and of the clutch, the torque produced on the clutch would lie along the axis and would have no component perpendicular thereto. This method of eliminating any undesired component of torque has the disadvantage that it works for loads in one direction, but is worse for loads in the other direction. For clockwise rotation, the loads would be supported by spring tangs 113 and 121 which are separated in the axial direction so that the forces on the tangs would produce a substantial component of torque perpendicular to the clutch axis. This would add undesirably to the bearing loads.

In some applications of our invention the driven load is connected to the clutch so that the output torque is in the form of a pure couple. In such applications there will be no bearing loads resulting from the driven loads, however, in the absence of our invention there would still be frictional loads resulting from the reaction to the spring tang load. Additionally, there would remain bearing reactions due to the operation of the control loop. Thus, there would continue to be the unpleasant variability in operating effort resulting from the cyclic change in the vector sum of the control loop induced bearing reactions and the spring tang induces bearing reaction.

Figure 13:
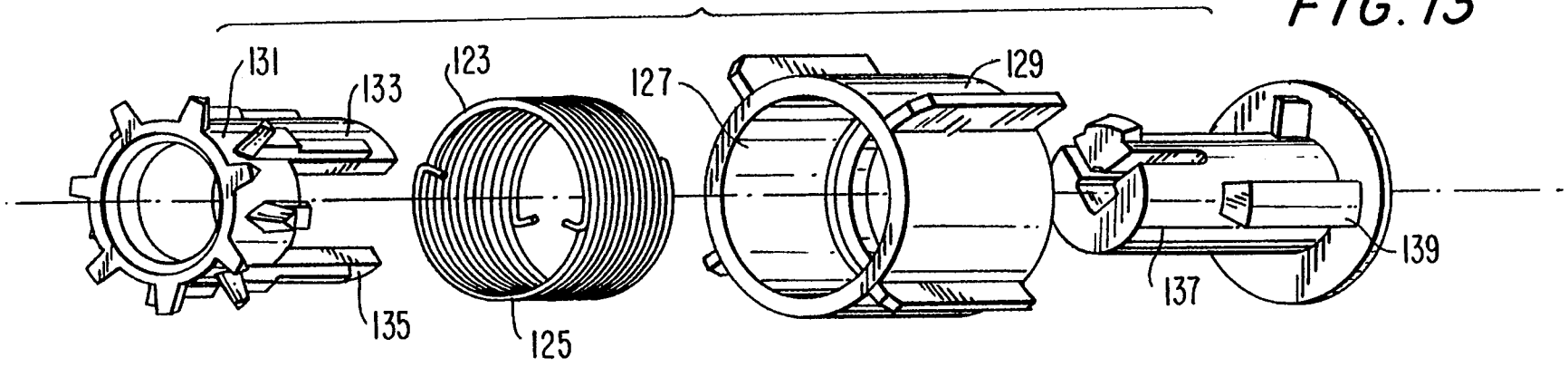

The arrangement of components shown in FIGS. 1–11 are typical in devices where it is advantageous to have a grounded innermost element while the rotating element is outermost. This is the preferred embodiment in the operation of window shades as it permits convenient support of the shaft by the shade bracket while the clutch housing supports the shade roller. Our invention is equally applicable to devices in which these roles are reversed. That is, there is an outermost shaft which would ordinarily be the housing for the clutch. One of its surfaces would be the surface with which the springs make frictional contact. Often, although not necessarily, the housing, or shaft remains stationary in operation. The central element in such a device would ordinarily be the output element, often referred to as the core, with the pulley, or control element radially between the housing and the central element. FIG. 13 shows such a clutch. Its construction is analogous to the construction of the clutch of FIGS. 10 and 11. The surface with which the springs 123 and 125 make frictional contact is the interior cylindrical surface 127 of shaft 129. As in the clutch of FIGS. 10 and 11, spring 123 and 125 are interleaved. This configuration is preferred because it provides the best symmetry, but any one of the alternative spring arrangements discussed above can advantageously be used in this configuration of clutch. As before, the cylindrical extension of pulley 131 has two drive sectors 133 and 135 for controlling the tangs of springs 123 and 125. Core 137 has two keys located on opposite sides for contacting the tangs of springs 123 and 125. Key 139 is visible in FIG. 13, the key on the opposite side is hidden in the drawing. The operation of this clutch is also analogous the operation of the clutches previously discussed, the two springs providing restraining forces balanced about the axis so that no net bearing loads result.

It will thus be seen that the objects set forth above among those made apparent from the preceding description, are efficiently attained and, since certain changes may be made in the construction of the inventive spring clutch without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed:

1. A spring clutch for lowering and raising a window shade comprising:

a shaft;

at least first and second helically wound axially mounted springs having first and second ends for making frictional contact with the shaft;

first engaging means corresponding to each of said at least first and second springs for selectively applying a tightening force to one of said ends of each of said springs for inhibiting rotation thereof with respect to said shaft;

second engaging means for selectively applying a loosening force to the other of said ends of each of said springs for promoting rotation thereof with respect to said shaft;

wherein each of said first engaging means is radially and symmetrically disposed about said shaft for substantially eliminating radial bearing forces.

2. The spring clutch of claim 1, wherein the shaft has an outer cylindrical surface and said at least first and second springs are disposed about said outer cylindrical surface for making frictional contact with the shaft.

3. The spring clutch of claim 2, further comprising a housing coaxially mounted about the shaft, said at least first and second springs located between the shaft and the housing.

4. The spring clutch of claim 3, wherein the housing includes said first engaging means.

5. The spring clutch of claim 4, wherein the housing is rotatably mounted about the shaft.

6. The spring clutch of claim 5, wherein said tightening force is applied by relative rotational movement of the housing with respect to the shaft.

7. The spring clutch of claim 6, wherein each of said spring ends comprises a tang element for selective operative engagement by the housing engaging means during relative rotational movement of the housing with respect to the shaft.

8. The spring clutch of claim 7, wherein said second engaging means comprises at least first and second drive sectors for selectively contacting the other of said tang elements of each of said at least first and second springs.

9. The spring clutch of claim 7, wherein said first engaging means comprises at least first and second keys of said housing for selectively contacting one of said tang elements of each of said at least first and second springs during rotational movement of the housing with respect to the shaft.

10. The spring clutch of claim 9, wherein said at least first and second keys are substantially symmetrically disposed about said housing.

11. The spring clutch of claim 7, further including means for reducing the component of torque perpendicular to the axis of said shaft when selectively applying said tightening force.

12. The spring clutch of claim 11, wherein the forces acting on the spring tangs are symmetrically disposed about a line perpendicular to and a point along the axis of said shaft.

13. The spring clutch of claim 7, wherein said at least first and second springs comprise a pair of interleaved springs.

14. The spring clutch of claim 13, wherein said tang elements of said pair of springs are located in a common plane perpendicular to the axis of the shaft.

15. The spring clutch of claim 7, wherein said at least first and second springs comprise a first spring with a clockwise helix and a second spring with a counterclockwise helix.

16. The spring clutch of claim 15, wherein said tang elements are located in a common plane perpendicular to the axis of the shaft.

17. The spring clutch of claim 1, wherein the shaft has an inner cylindrical surface and said at least first and second springs are disposed along said inner cylindrical surface for making frictional contact with the shaft.

18. The spring clutch of claim 17, further comprising a core coaxially mounted within said shaft, said at least first and second springs being located between the shaft and the core.

19. The spring clutch of claim 18, wherein said core includes said first engaging means.

20. The spring clutch of claim 19, wherein the core is rotatably mounted within the shaft.

21. The spring clutch of claim 20, wherein said tightening force is applied by relative rotational movement of the core with respect to the shaft.

22. The spring clutch of claim 21, wherein each of said spring ends comprise a tang element for operative selective engagement by the core engaging means during relative rotational movement of the core with respect to the shaft.

23. The spring clutch of claim 22, wherein said first enraging means comprises at least first and second keys of said core for selectively contacting said one of said tang elements of each of said at least first and second springs during rotational movement of the core with respect to the.

24. The spring clutch of claim 23, wherein said at least first and second keys are substantially symmetrically disposed about said core.

25. The spring clutch of claim 24, wherein said at least first and second springs comprise a pair of interleaved springs.

26. The spring clutch of claim 22, wherein said second engaging means comprises at least first and second drive sectors for selectively contacting the other of said tang elements of each of said at least first and second springs.

27. The spring clutch of claim 1, wherein said spring clutch is in assembly with a window shade system.

28. The spring clutch of claim 27, wherein said window shade system includes a shade wound about and attached to a roller, and a pulley having a cylindrical member coaxially disposed inside said roller.

29. The spring clutch of claim 28, wherein said shaft with said mounted spring is disposed coaxially with respect to the cylindrical member of said pulley.

30. A spring clutch for lowering and raising a window shade comprising:

a shaft;

at least first and second helically wound axially mounted springs for making frictional contact with the shaft and having first and second ends;

first engaging means corresponding to each of said at least first and second springs for selectively applying a tightening force to one of said ends of each of said springs for inhibiting rotation thereof with respect to said shaft;

second engaging means for selectively applying a loosening force to the other of said ends of each of said springs for promoting rotation thereof with respect to said shaft;

wherein each of said first engaging means is radially and substantially symmetrically disposed about said shaft for substantially eliminating radial bearing forces;

wherein said at least first and second springs are mounted in order to reduce the component of torque perpendicular to the axis of the shaft when selectively applying said tightening and loosening forces.

* * * * *